US007666030B2

(12) United States Patent
Yi et al.

(10) Patent No.: US 7,666,030 B2
(45) Date of Patent: Feb. 23, 2010

(54) ELECTRICAL CONNECTOR WITH ESD PROTECTION

(75) Inventors: Chong Yi, Mechanicsburg, PA (US); Joseph Ortega, Camp Hill, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/321,983

(22) Filed: Jan. 27, 2009

(65) Prior Publication Data

US 2009/0149066 A1 Jun. 11, 2009

Related U.S. Application Data

(63) Continuation of application No. 11/978,870, filed on Oct. 30, 2007, now Pat. No. 7,481,677.

(51) Int. Cl.
*H01R 13/648* (2006.01)

(52) U.S. Cl. ..... 439/607; 439/541.5

(58) Field of Classification Search ..... 439/541.5, 439/607.01, 607.23–607.25, 607.06, 607.13, 439/924.1

See application file for complete search history.

(56) References Cited

U.S. PATENT DOCUMENTS 7,445,505 B1 * 11/2008 Yi ..... 439/607.01
2008/0311801 A1 * 12/2008 Chen et al. ..... 439/733.1

* cited by examiner

*Primary Examiner*—Hae Moon Hyeon
(74) *Attorney, Agent, or Firm*—Wei Te Chung; Andrew C. Cheng; Ming Chieh Chang

(57) ABSTRACT

An electrical connector has an insulative housing (10) and a number of electrical contacts (20). The insulative housing has a tongue (14, 15) defining a front face (145) and an upper side and a lower side perpendicular to the front face. The electrical contacts include a number of upper contacts (21) and lower contacts (22). The lower contacts are arranged on the lower side of the tongue and each including a contact section. The upper contacts each includes an extending section (212) arranged on the upper side of the tongue. A contact section (215) is bending from a side edge of the extending section of the upper contact and extending through a passageway (147) of the tongue for arranging on the lower side and avoiding the upper contacts shorting to a metal shell of a mating plug.

16 Claims, 6 Drawing Sheets

ELECTRICAL CONNECTOR WITH ESD PROTECTION

This is a continuation application of a application Ser. No. 11/978,870, filed Oct. 30, 2007, now U.S. Pat. No. 7,481,677.

BACKGROUND OF THE INVENTION

1. Field of the Invention

The present invention relates generally to electrical connector, and more particularly to a connector having improved electrical contacts.

2. Description of Related Art

Electrical connectors are typically used to couple PCB (Printed Circuit Board) which have numerous electrical devices. Some electrical connectors have a mating end wherein conductive terminals are exposed for engagement with the terminals of a mating connector. When mating the connectors, opposite charges at the connector interface may result in an ESD between the two connectors. In fact, electrostatic discharges can be generated simply by a person approaching or touching the connector interface or touching the terminal contacts. As known, when the ambient relative humidity drops to fifty percent or below, the human body accumulates a large electrical charge which can be in excess of 20,000 volts. Generally, very little current is associated with an electrostatic discharge; however, the voltage can be high enough to damage or destroy certain types of electrical devices such as semiconductor devices. Consequently, when the connector contacts or terminals are electrically associated with such devices on a circuit board, the electrostatic discharge may damage or destroy the electrical devices on the circuit board.

In order to alleviate the electrostatic discharge problem, some electrical connectors include features to provide ESD protection. In at least some connectors, ESD protection is provided with a shield in the form of a plate, bar, or the like located proximate the connector interface and connected to ground on or proximate the connector. But sometimes, the electrostatic discharge also happens to the signal contacts. Please refer to FIG. 6, which discloses an electrical connector 300 having J-shaped contacts 60 and a portion 61 thereof is exposed at the front area of the connector 300. A mating plug 200 could touch the portion 61 of the contacts 60 during mating. There is a potential for the high speed contacts 60 thereof to short with the shell 40 of the mating plug 200 which could also result in ESD problem.

Hence, it is desired to provide an electrical connector to overcome the problems mentioned above.

BRIEF SUMMARY OF THE INVENTION

Accordingly, an object of the present invention is to provide an electrical connector having improved electrical contacts for ESD protection.

In order to obtain the object, an electrical connector for mating with a complementary plug comprises an insulative housing and a plurality of electrical contacts attached thereto. The insulative housing has a rear section and a tongue extending from the rear section. The tongue defines a front face at a front end thereof. The tongue also comprises an upper side and a lower side perpendicular to the front face. The electrical contacts include a plurality of upper contacts and a plurality of lower contacts. The lower contacts are arranged on the lower side of the tongue and each including a contact section for contact with the plug. The upper contacts each includes an extending section arranged on the upper side of the tongue. A contact section is bending from a side edge of the extending section of the upper contact and extending through a passageway of the tongue to be arranged on the lower side of the tongue.

Other objects, advantages and novel features of the invention will become more apparent from the following detailed description of the present embodiment when taken in conjunction with the accompanying drawings.

DETAILED DESCRIPTION OF THE PREFERRED EMBODYMENT

Figure 1:
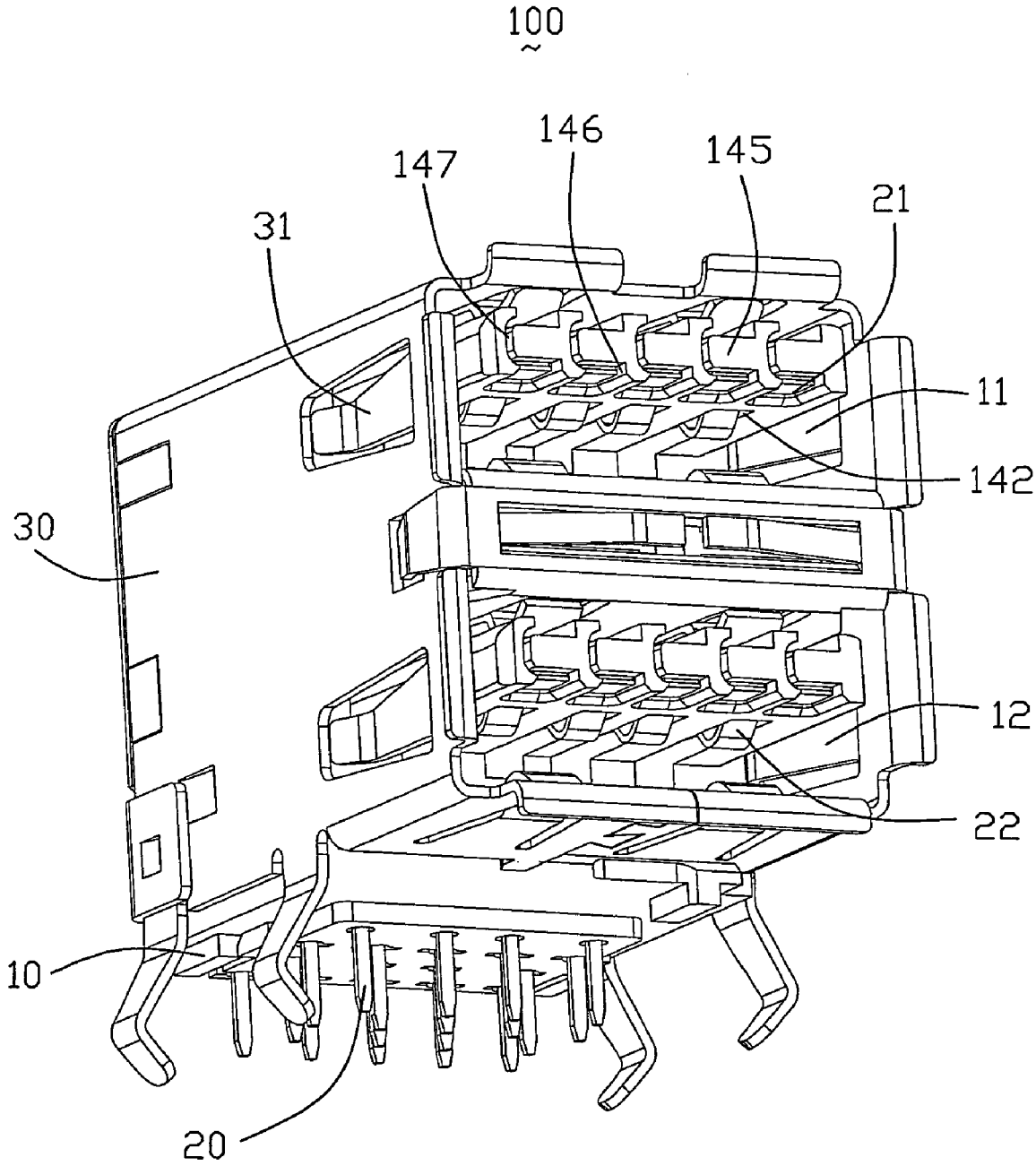
FIG. 1 is a perspective view of an electrical connector according to the present invention.

Reference will be made to the drawing figures to describe the present invention in detail, wherein depicted elements are not necessarily shown to scale and wherein like of similar elements are designated by same or similar reference numeral through the several views and same or similar terminology.

Figure 5:
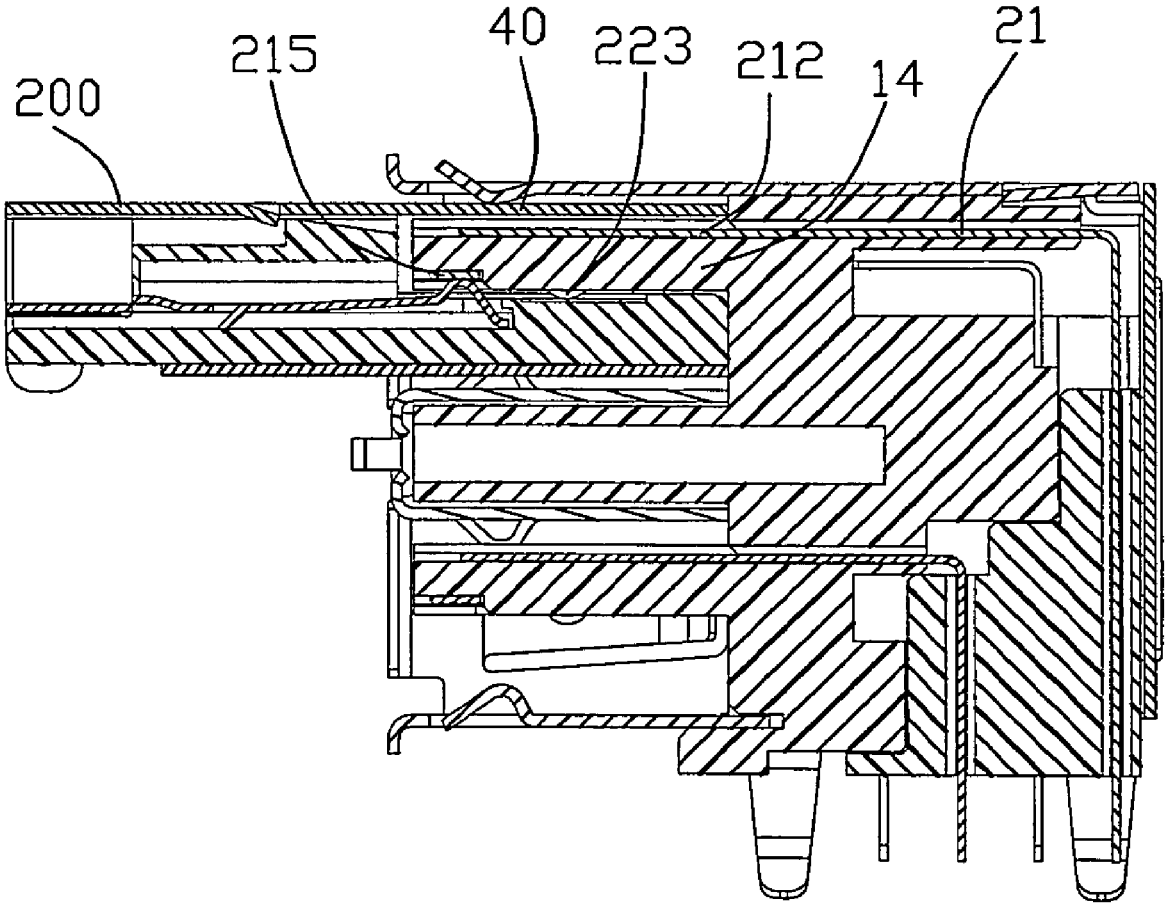
FIG. 5 is a cross sectional view of the electrical connector shown in FIG. 1, wherein an mating plug is inserted therein.
Figure 6:
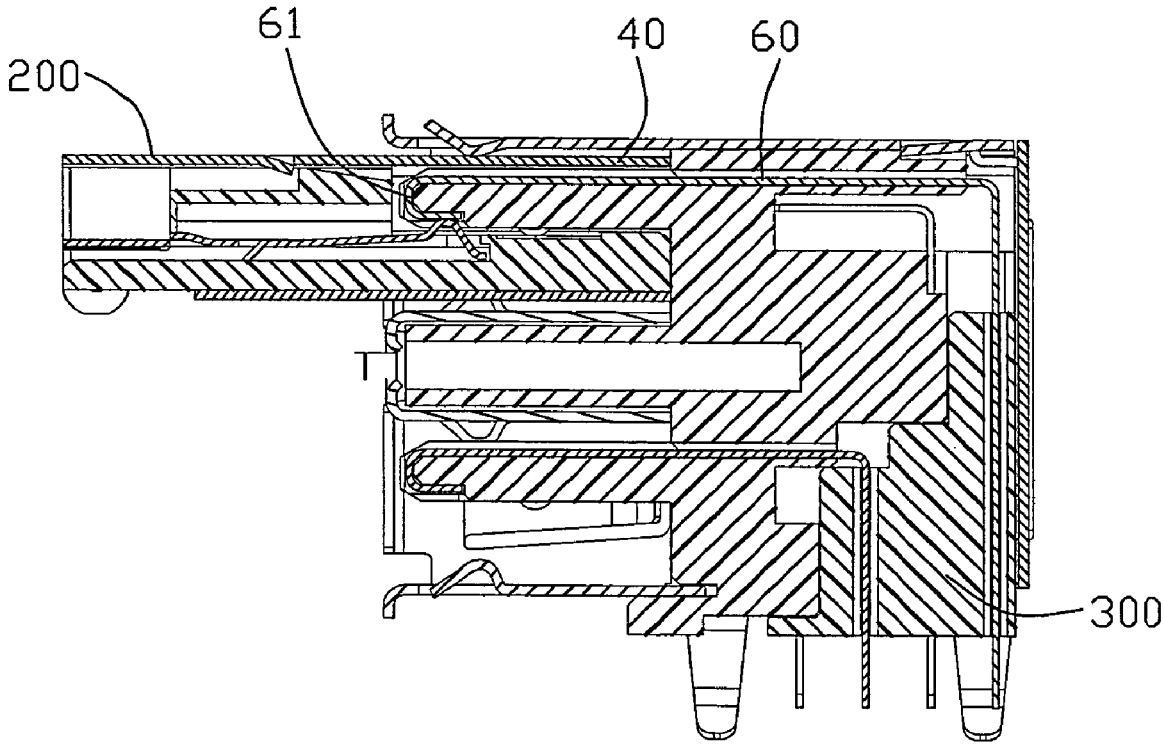
FIG. 6 (PRIOR ART)
FIG. 6 is a cross sectional view of a related art with a mating plug inserted therein.

Referring to FIG. 1, the present invention is directed to an electrical connector 100 mounting to a PCB or motherboard having an insulative housing 10 including a plurality of receiving spaces or receptacle openings 11, 12 each adapted to receive a complementary electrical plug 200 as shown in FIG. 5. The connector 100 includes a plurality of electrical contacts 20 arranged in the first and second groups corresponding to a respective one of the receptacle openings 11, 12. The connector 100 has an outer shield 30 that generally surrounds the housing 10 and has grounding contacts 31 to create an electrical connection between the conductive outer shield 30 and the plug 200 when inserted therein.

While the drawings display a dual stacked connector system 100, the present invention could be used with any type of electrical connector. While each receptacle is shown with nine contacts 20 in a group, the invention can be employed with any desired number of contacts 20 in a group. Similarly, while two receptacles 11, 12 are shown, the invention can be employed with a single receptacle or any desired number of stacked receptacles.

Figure 2:
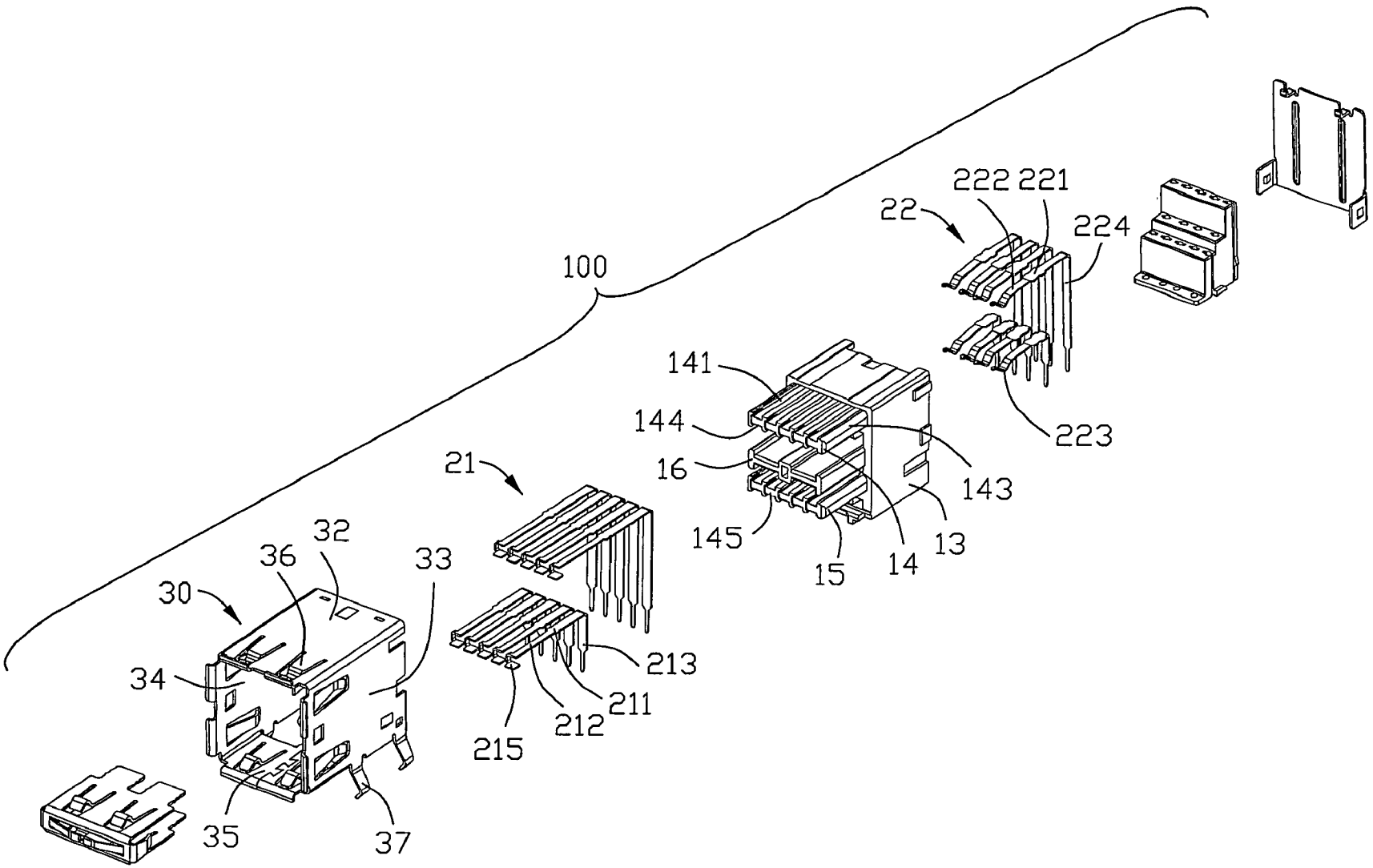
FIG. 2 is an exploded view of the electrical connector shown in FIG. 1.

Referring to FIGS. 1 and 2, the shield 30 is preferably stamped from a single sheet of suitable conductive material, which includes a top wall 32, opposed lateral walls 33, 34, and a bottom wall 35. The opposed top and bottom walls 32, 35 each have longitudinal springs 36 bent so as to extend into the receptacles 11, 12 to bear against a corresponding shield 40 of the plug 200. Board locks 37 mate with the PCB and aid in positioning the electrical connector 100 with respect to the PCB.

Figure 4:
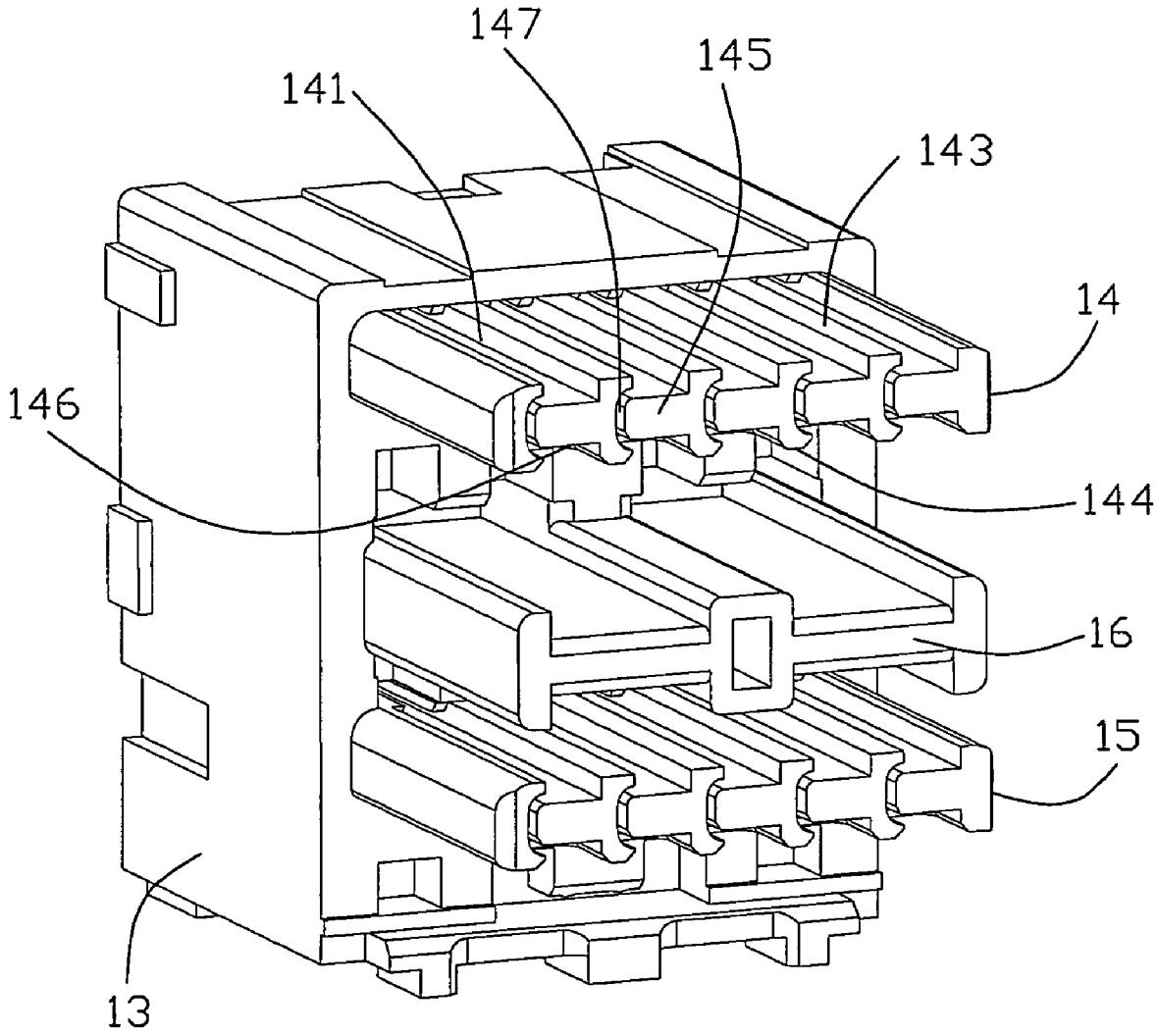
FIG. 4 is a perspective view of the insulative housing shown in FIG. 1.

As illustrated in FIGS. 1, 2 and 4, the insulative housing 10 has a rear section 13 with tongues 14, 15 extending forwardly therefrom. The upper and lower tongue 14, 15 carry the contacts 20. The contacts 20 may be signal contacts, power contacts, or ground contact in various combinations as desired in accordance with a particular application. Each tongue 14, 15 defines a row of recess 142 at the lower face 144, i.e., a first face, which functions as a mating face, and a row of recess 141 at the upper face 143, i.e., a second face thereof. Upper recesses 141 are extending to a front edge l45 of the tongue 14, 15 and the front edge 145 are perpendicular to the upper and lower faces of the tongue 14, 15. The tongue 14, 15 also defines a row of notches 146 at the lower face 144 and located between the lower recesses 142 and the front edge 145 along the mating direction of the electrical connector 100. A plurality of passageways 147 extend from the side edges of the upper recesses 141 and through the tongue 14, 15 for communicating with the lower notches 146 and the upper recesses 141. The passageways 147 are perpendicular to the front edge 145. Also as illustrated, a middle flange 16 extends from the housing 10 to separate receptacle openings 11, 12.

Figure 3:
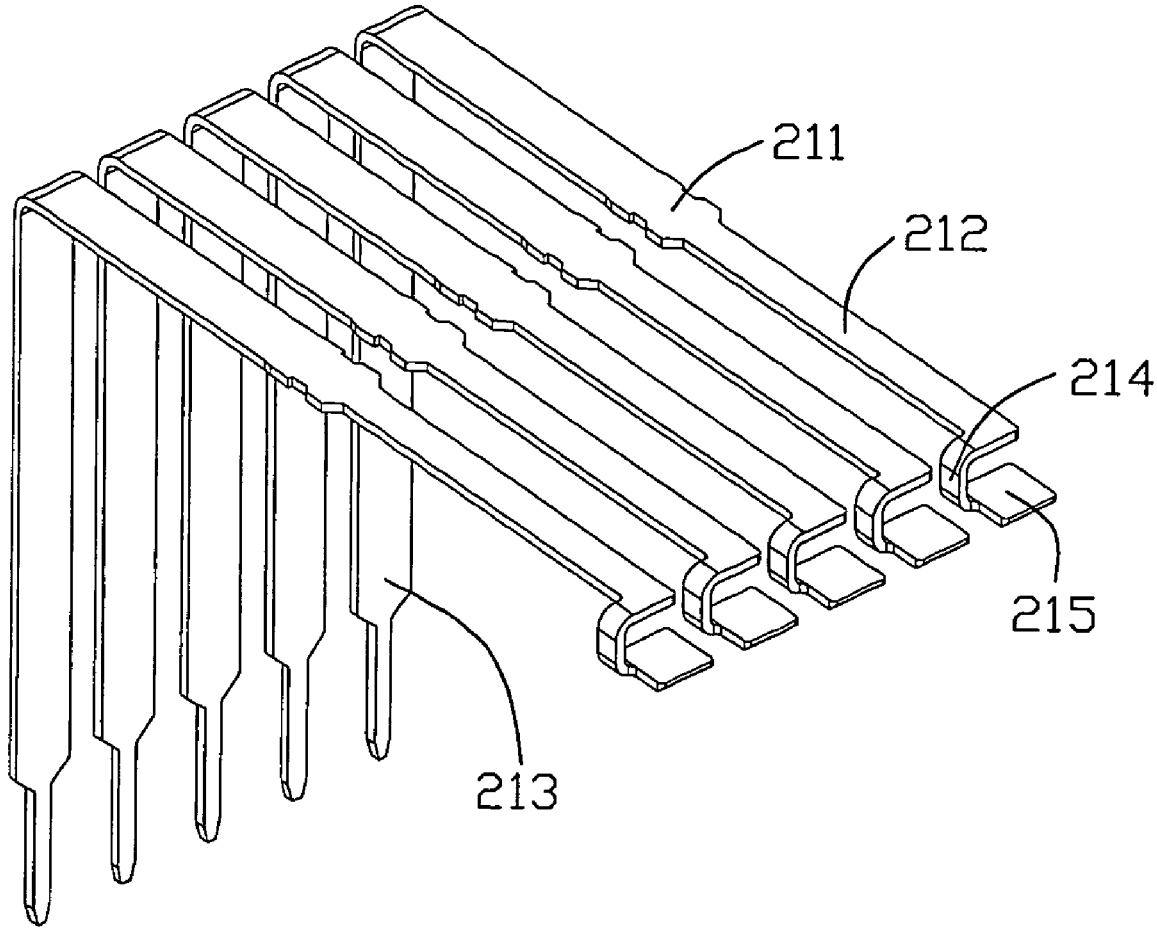
FIG. 3 is a perspective view of the upper contacts shown in FIG. 1.

Referring to FIGS. 2 and 3, each group of electrical contacts 20 includes a row of upper contacts 21 and a row of lower contacts 22. Each lower contact 22 includes a retention section 221 engaging with the isulative housing 10. An elastic contact section 222 extends from one end of the retention section 221 in a direction generally parallel to the tongues 14, 15 and has a convex bend 223 mating with a complementary contact (not shown) of the mating plug 200. The contacts sections 222 are received in the lower recesses 142 of the insulative housing 10. The lower contacts 22 also include a mounting section 224 extending from the other end of the retention section 221 for mounting to the PCB.

Each upper contacts 21 also includes a retention section 211 engaging with the insulative housing 10, an extending section 212 extending from one end of the retention section 211, and a mounting section 213 extending from the other end of the retention section 211. The extending section 212 is parallel to the tongue 14, 15 and received in the upper recess 141. A connect section 214 is bending from a side edge of the extending section 212 at the front end thereof and perpendicular to the front edge 145. A flat nonealstic contact section 215 is connected with the connect section 214 and parallel to the extending section 212. The contact sections 215 and the connect sections 214 are received in the notches 146 and the passageways 147, respectively.

As illustrated in FIGS. 1 and 5, the contact sections 215, 222 of the upper contacts 21 and the lower contacts 22 are located on the lower face 144 of the tongue 14, 15 and staggered along the mating direction of the electrical connector 100. The contact sections 215 of the upper contacts 21 are close to the front edge 145 than the contact sections 222 of the lower contacts 22. The recesses 141 on the upper face 143 are open upwards so that the extending sections 212 and some parts of the retention sections 211 between the contact section 215 and the mounting section 213 are exposed on the upper face 143 and lie upon the upper face 143 for confrontation with a complementary connector as best shown in FIG. 5. The contact points, namely the contact sections 215 and the convex bends 223 of the upper contacts 21 and the lower contacts 22 also staggered along the vertical direction so that to mate with the corresponding contacts (not labeled) of the plug 200 at different height.

The extending section 212 and the contacts section 215 are connected by the connect section 214 at the side edge thereof so that a front end of the upper contact 21 is located in the interior of the tongue 14, 15. Therefore, an intervening spacing is generated between the front edge 145 and the front ends of the upper contacts 21 to prevent the upper contacts 21 contacting with the shell 40 of the plug 200 and avoid the ESD problem to the upper contacts 21.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector comprising:

an insulative housing defining a mating tongue with thereon a mating face facing toward a mating port in which the mating tongue is located;

a set of first contacts disposed in the housing and each defining a first contact section on a front region of the mating face, and a first mounting section behind the mating tongue; and a set of second contacts disposed in the housing and each defining a second contact section on a rear region of the mating face, and a second mounting section behind the mating tongue; wherein no portions of either the first contacts or the second contacts are substantially exposed upon a front edge of the mating tongue in a mating direction so as to prevent ESD (Electrostatic Discharge); wherein said mating tongue defines another face opposite to the mating face, and an extending portion of each of said first contacts, which is located between the first contact section and the first mounting section, lies upon said another face for confrontation with a complementary connector.

2. The electrical connector as claimed in claim 1, wherein said extending portion is connected to the first contact section via a connection section which essentially extends therethrough the mating tongue from said another face to said mating face.

3. The electrical connector as claimed in claim 2, wherein said mating tongue defines a slot to receive said connection section.

4. The electrical connector as claimed in claim 3, wherein said slot extends inwardly from said front edge of the mating tongue in said mating direction to receive said connection section as so to allow the corresponding first contact to be assembled to the housing in said mating direction.

5. The electrical connector as claimed in claim 1, wherein the mating tongue defines a plurality of recesses in said another face to receive the extending portions of the set of first contacts, respectively.

6. The electrical connector as claimed in claim 5, wherein said mating tongue defines a plurality of recesses in said mating face to receive the second contact sections of the set of second contacts, respectively.

7. The electrical connector as claimed in claim 1, wherein either the first contact or the second contact is essentially completely located behind said front edge of the mating tongue.

8. The electrical connector as claimed in claim 7, wherein said front edge of the mating tongue extends in a vertical plane perpendicular to said mating face and said another face.

9. The electrical connector as claimed in claim 1, wherein said mating port is defined by a metallic shell attached to the housing and enclosing said mating tongue.

10. The electrical connector as claimed in claim 9, wherein both said mating face and said another face are adapted to confront the complementary connector within said mating port.

11. An electrical connector comprising:

an insulative housing having a main body with a mating tongue extending forwardly therefrom, said mating tongue defining thereon opposite first and second faces behind a front edge of said mating tongue;

a set of first contacts disposed in the housing, each of said first contacts defining a stiff first contact section located on a front region of the first face, and a first mounting section behind the mating tongue;

a set of second contacts disposed in the housing and each of said second contacts defining a deflectable second contact section on a rear region of the mating face, and a second mounting section behind the mating tongue;

each of said first contacts further including an extending section exposed upon the second face and located behind the first contact section while in front of the first mounting section, and further including a connection section located between the first contact section and the extending section extending through the mating tongue to connect said first contact section and said extending section under condition of said connection section being essentially protectively hidden, without exposure, behind the front edge of the mating tongue for preventing ESD (Electrostatic Discharge);

12. The electrical connector as claimed in claim 11, wherein said extending section is stiff during use.

13. The electrical connector as claimed in claim 11, wherein said first contact section and said corresponding extending section are essentially parallel to each other while at different level.

14. The electrical connector as claimed in claim 11, wherein both said first face and said second face define a plurality of grooves therein to receive the second contact sections of the second contacts and said extending sections of the first contacts, respectively.

15. The electrical connector as claimed in claim 11, wherein said first contact defines a retention section which is coplanar with said extending section.

16. The electrical connector as claimed in claim 5, wherein said connection section is located in a slot which communicates with an exterior in a front-to-back direction.

* * * * *